US006805639B2

(12) United States Patent
Maruszczak

(10) Patent No.: US 6,805,639 B2
(45) Date of Patent: Oct. 19, 2004

(54) TARGET FOR A ROLLED BALL

(76) Inventor: William I Maruszczak, 432 Robin Hill Rd., Wayne, PA (US) 19087

( * ) Notice: Subject to any disclaimer, the term of this patent is extended or adjusted under 35 U.S.C. 154(b) by 0 days.

(21) Appl. No.: 10/188,179

(22) Filed: Jul. 5, 2002

(65) Prior Publication Data

US 2004/0005933 A1 Jan. 8, 2004

(51) Int. Cl.[7] ..... A63B 69/36

(52) U.S. Cl. ..... 473/190; 273/127 D; 473/176; 473/153

(58) Field of Search ..... 473/190–192, 473/180, 153, 176, 177; 273/127 A, 127 B, 127 C, 127 D, 127 R; 116/173–175

(56) References Cited

U.S. PATENT DOCUMENTS 1,844,735 A * 2/1932 Young ..... 473/191
2,220,492 A * 11/1940 Piesco ..... 473/192
2,236,869 A * 4/1941 Daigle ..... 473/182
2,453,605 A * 11/1948 Thomas ..... 473/180
3,602,516 A * 8/1971 Doherty ..... 473/180
3,797,833 A * 3/1974 Rokusek ..... 473/180
5,938,537 A * 8/1999 Liu ..... 473/192
6,287,213 B1 * 9/2001 Selton ..... 473/180
2002/0107080 A1 * 8/2002 Hsu ..... 473/191

* cited by examiner

*Primary Examiner*—Mark S. Graham
(74) *Attorney, Agent, or Firm*—LaMorte & Associates

(57) ABSTRACT

A ball target assembly into which a rolling ball is directed and the associated method of playing a game using the ball target assembly. The ball target assembly has a base section wherein at least one ramp extends from the base section. A cup is disposed in the top surface of the base section. The ramp provides a surface upon which a rolling ball approaching the base section can roll to reach the cup. A flag indicator is provided that is selectively positionable between a down position and a raised position. The position of the flag indicator is controlled by an activation mechanism. The activation mechanism moves the flag indicator from its down position to its raised position when a ball is received in the cup. As such, when a ball rolls into the cup, the flag indicator automatically is raised.

9 Claims, 4 Drawing Sheets

TARGET FOR A ROLLED BALL

BACKGROUND OF THE INVENTION

1. Field of the Invention

The present invention relates to targets, used either for practice or for a game, into which balls are rolled. More particularly, the present invention relates to novelty targets into which golf balls are directed while either practicing the game of golf or playing a simulated game of golf.

2. Prior Art Statement

There are many practice devices that relate to the game of golf. Many such practice devices are used to develop putting skills. Devices that are designed to practice putting typically come with a ball target that simulates the hole on a putting green. A person practicing putting then typically tries to putt a golf ball into the ball target from a variety of points.

The prior art is replete with ball targets that are used by golfers to practice putting. Some ball targets are expensive complex mechanisms that contain ball return devices that propel the golf ball back toward the putter after the ball is received in the ball target. However, most ball targets for practicing putting are simple inexpensive targets, such as static rings or cups that are placed on the floor.

In addition to practice devices that are used by real golfers, there also exist many types of ball targets that are used by children who are playing a simulated game of golf with toy golf clubs and toy golf balls. Typically, a toy golf ball is larger than a regulation golf ball. Consequently, the ball target also tends to be larger. Ball targets for toy golf clubs also tend to be large, brightly colored and easy to handle so that they can be readily handled by children. Furthermore, to increase the play value of a toy golf game, the ball target for a toy game of golf is seldom a simple ring. Rather, to better hold a child's imagination, toy golf targets are commonly shaped like an alligator's mouth or some other novelty construction that would be interesting to a child.

As a consequence, in the prior art, there are not many ball targets that provide a realistic target to a real golfer, yet are interesting enough to have play value for a child playing a simulated game of golf. A need therefore exists for a ball target that can be used by seasoned golfers, young learning golfers and children just playing a simulated game of golf, that is realistic to the seasoned golfer and interesting to the novice or pretend golfer. This need is met by the present invention as described and claimed below.

SUMMARY OF THE INVENTION

The present invention is a ball target assembly into which a rolling ball is directed and the associated method of playing a game using the ball target assembly. The ball target assembly has a base section wherein at least one ramp extends from the base section. A cup is disposed in the top surface of the base section. The ramp provides a surface upon which a rolling ball approaching the base section can roll to reach the cup. A flag indicator is provided that is selectively positionable between a down position and a raised position. The position of the flag indicator is controlled by an activation mechanism. The activation mechanism moves the flag indicator from its down position to its raised position when a ball is received in the cup. As such, when a ball rolls into the cup, the flag indicator automatically is raised.

The activation mechanism can either use kinetic energy from the rolling ball to raise the flag indicator or can use the presence of the ball in the cup to trigger a secondary mechanism that raises the flag indicator.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention ball target can be used with any type of rolling ball, it is especially useful when practicing putting for the regulation game of golf or playing a simulated game of golf with a toy golf ball and toy putter. Accordingly, in the exemplary embodiment of the present invention ball target shown, the ball used in the description and the illustrations are golf balls in order to set forth the best mode contemplated for the invention and its associated method of use.

Figure 1:
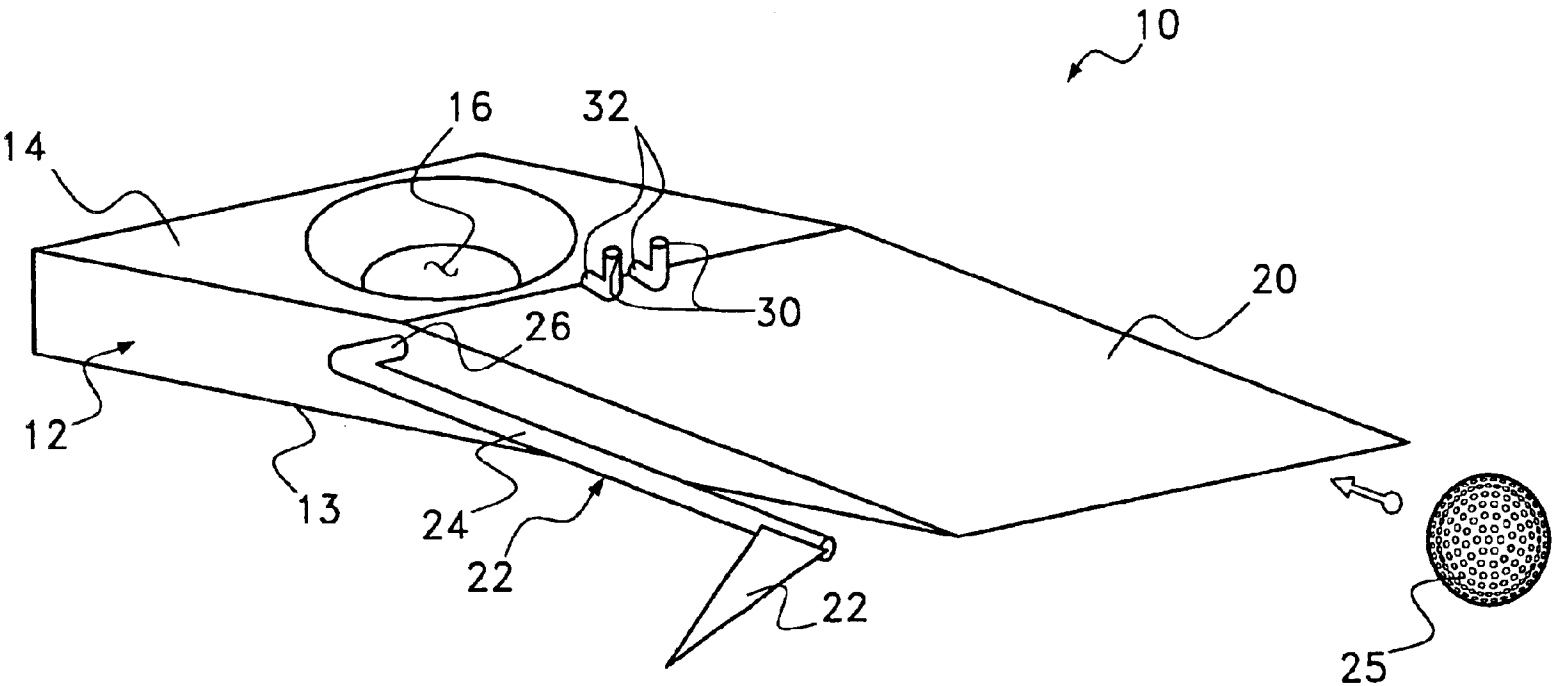
FIG. 1 is a perspective view of a first exemplary embodiment of the present invention ball target, shown in conjunction with an approaching golf ball.

Referring to FIG. 1, a first exemplary embodiment of the present invention ball target 10 is shown. The ball target 10 has a base section 12. The base section 12 has a flat bottom surface 13 that lays flat on the floor or any other planar surface. The base section 12 also has a flat top surface 14. The height of the base section 12, between the bottom surface 13 and the top surface 14 is preferably between ½ inch and four inches.

A cup 16 is formed in the top surface 14 of the base section 12. The cup 16 has an open top and is preferably the diameter of a regulation golf hole. A ramp 20 extends from at least one side of the base section 12. The ramp 20 presents a sloped surface that ascends from the floor up to the height of the base section 12. Accordingly, the ramp 20 presents a means for a ball rolling along the ground to roll up onto the top surface 14 of the base section 12 and into the cup 16.

A flag indicator 22 is positioned on the side of the base section 12. The flag indicator 22 consists of an elongated rod 24 and a flag 27 that is attached to the elongated rod 24 near its end. The flag indicator 22 moves between two positions. In the embodiment of FIG. 1, the flag indicator 22 is shown in its "down" position. In the down position, the elongated rod 24 of the flag indicator 22 is held in or near a horizontal orientation. As such, the elongated rod 24 does not extend above the top surface 14 of the base section 12. However, as will later be explained, when a ball 25 rolls up the ramp 20 and into the cup 16, the flag indicator 22 moves into a "raised" position. In the raised position, the elongated rod 24 is held in or near a vertical orientation and supports the flag 27 well above the top surface 14 of the base section 12.

In the embodiment of FIG. 1, the flag indicator 22 is moved from its down position to its raised position using the weight and the momentum of the ball 25 that rolls up the ramp 20. An axle rod 26 extends laterally into the base section 12 of the ball target 10. The axle rod 26 is free to rotate within the base section 12 of the ball target 10. The bottom of the elongated rod 24 is attached to the axle rod 26. In fact, the elongated rod 24 and the axle rod 26 may be a single piece of metal that is bent at a right angle. As such, part of the piece of metal acts as the elongated rod and part of the piece of metal acts as the axle rod.

At least one arm activator 30 extends upwardly through the top surface 14 of the base section 12 near the top of the ramp 20. In the shown embodiment, two arm activators 30 are shown. However, it should be understood that one arm activator 30 or any plurality of arm activators 30 can be used. The arm activators 30 are attached to the axle rod 26 in the base section 12, wherein the arm activators 30 radially extend from the axle rod 26.

Slots 32 are formed in the top surface 14 of the base section 12. The arm activators 30 extend up from the axle rod 26 through the slots 32. The slots 32 enable the arm activators 30 to rotate down into the base section 12 if impacted by a rolling ball 25.

Figure 2:
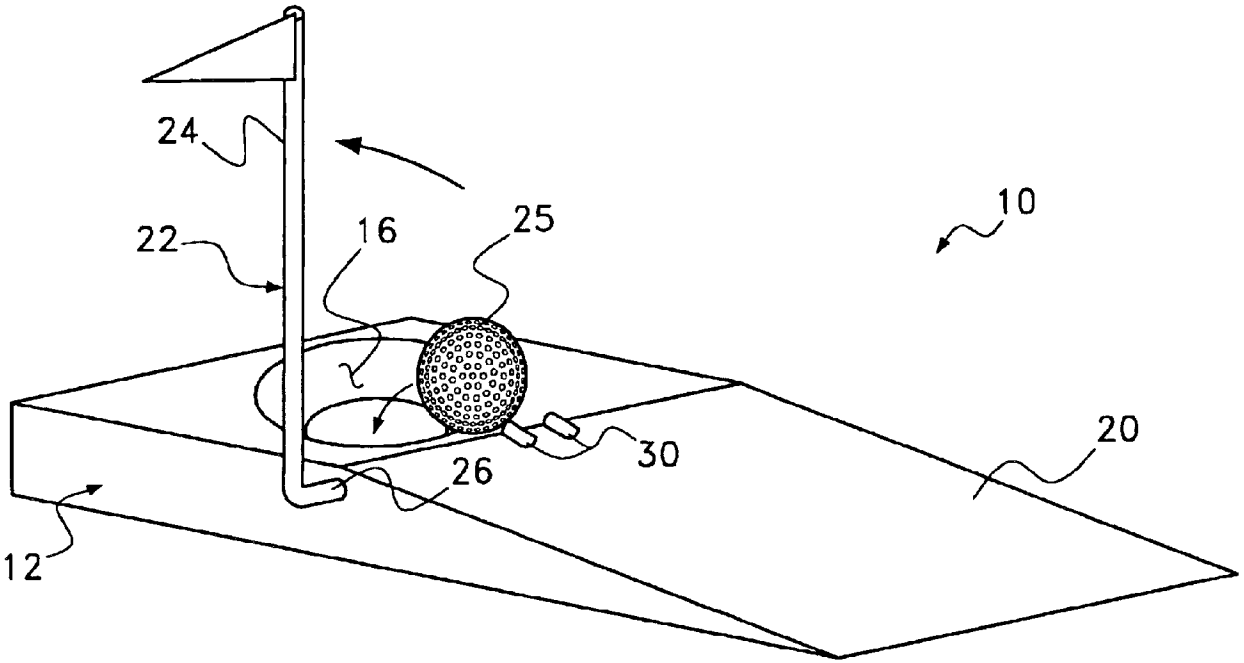
FIG. 2 is a perspective view of the embodiment of the ball target previously shown in FIG. 1, wherein a flag indicator is raised by a rolling ball approaching the cup.

Referring now to FIG. 2, it can be seen that as a ball 25 rolls up the ramp 20 toward the cup 16, the ball 25 contacts at least one of the arm activators 30. As the ball 25 contacts one of the arm activators 30, the ball 25 rotates the arm activators 30 down into their slots 32 (FIG. 1). As the arm activators 30 are rotated by the incoming ball 25, the movement of the arm activators 30 is transferred to the axle rod 26 within the base section 12. Consequently, the axle rod 26 spins within the base section 12 of the ball target 10. Depending upon the angle of the arm activators 30 and the size of the slots 32 (FIG. 1), the passing of the ball 25 over the arm activators 30 can result in a corresponding rotation of the axle rod 26 of between 60 degrees and 120 degrees.

The elongated rod 24 of the flag indicator 22 is connected to the axle rod 26 at a perpendicular. As such, the elongated rod 24 radially extends from the longitudinal axis of the axle rod 26. Consequently, as the axle rod 26 rotates between 60 degrees and 120 degrees, the flag indicator 22 is raised from its down position up into its raised position. Preferably, when the flag indicator 22 is rotated into its fully raised position, the elongated rod 24 is raised to a position slightly beyond the vertical. In this manner, the flag indicator 22 remains in its raised position even after the ball 25 has passed over the arm indicators 30 and has fallen into the cup 16.

From the above description, it will be understood that as a ball 25 rolls up the ramp 20 and passes over the arm activators 30, the flag indicator 22 automatically moves into its raised position. Consequently, the flag indicator 22 moves into its raised position each time a ball 25 rolls up the ramp 20 and passes into the cup 16.

It is possible for a ball 25 to roll up the ramp 20 and pass across the side edge of the top surface of the base section 12 without the ball falling into the cup 16. By positioning the arm indicators 30 toward the center of the ramp 20, the ball 25 will only contact and move the arm activators 30 to raise the flag indicator 22 if the ball 25 is on the proper trajectory to enter the cup 16 after rolling up the ramp 20.

In the embodiment of FIG. 1 and FIG. 2, a ball 25 rolling up the ramp 20 contacts the arm activators 30, thereby causing the flag indicator 22 to move from its down position to its raised position. However, by positioning the arm activators 30 on the ramp 20, the arm activators 30 serve as a barrier to the forward progress of the ball 25. For instance, if a ball 25 is rolling up the ramp with just enough speed to make it up the ramp 20, the ball 25 would not have enough momentum to rotate the arm activators 30 and raise the flag indicator 22. Rather, the ball 25 would be stopped by the arm activators 30 and would roll back down the ramp 20.

Figure 3:
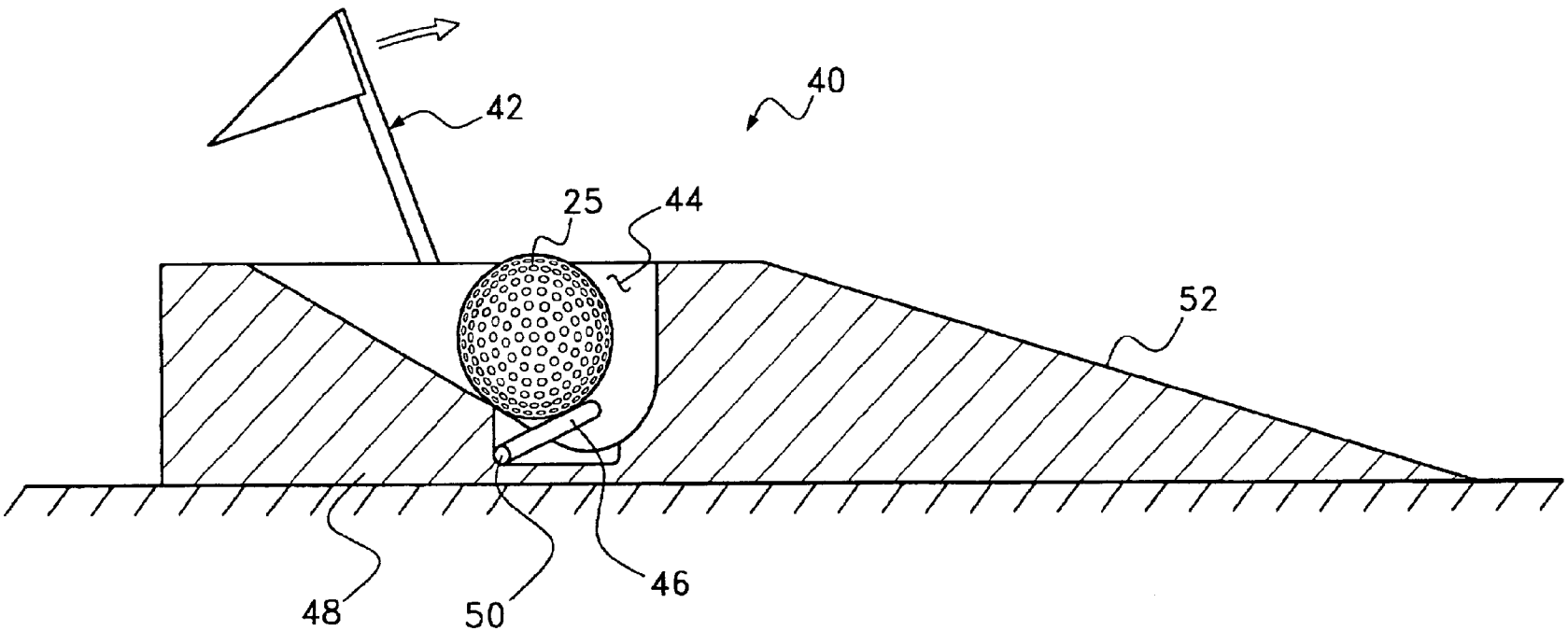
FIG. 3 shows a cross-sectional view of a second exemplary embodiment of the present invention ball target.

Referring now to FIG. 3, a ball target 40 is shown, wherein a flag indicator 42 moves into a raised position whenever a ball 25 rolls into a cup 44 that is formed in the ball target 40. From FIG. 3, it can be seen that an arm activator 46 can be positioned in the cup 44 within the base section 48 of the ball target 40. As the ball 25 rolls into the cup 44, the ball 25 contacts at least one arm activator 46. Under the weight of the ball 25, the arm activator 46 rotates in the observed clockwise direction. This rotation is transferred to an axle rod 50 that extends laterally through the ball target 40. The axle rod 50 transfers the rotation to the flag indicator 42, thereby causing the flag indicator 42 to rotate into its raised position.

By having the arm activators 46 positioned within the cup 44, the flag indicator 42 will rise anytime a ball 25 falls into the cup 44. The arm activators 46 therefore do not act as barriers to the movement of the ball 25. Furthermore, ramps 52 can extend from different sides of the base section 48 of the ball target 40. A player therefore, does not have to be concerned with striking a certain position of a particular ramp 52 in order to cause the flag indicator 42 rise.

In the embodiments of FIG. 1 and FIG. 3, the weight and momentum of the ball rolling into the cup provides the kinetic energy needed to raise the flag indicator 42. This system works well if regulation golf balls are being used as the ball. Regulation golf balls have a high weight-to-size ratio. Consequently, regulation golf balls typically would have the momentum needed to raise the flag indicator. However, toy golf balls and other toy balls are often molded from thin plastic. Such toy balls typically have a very low weight-to-size ratio. Consequently, toy balls do not have the momentum needed to raise the flag indicator mechanically.

Figure 4:
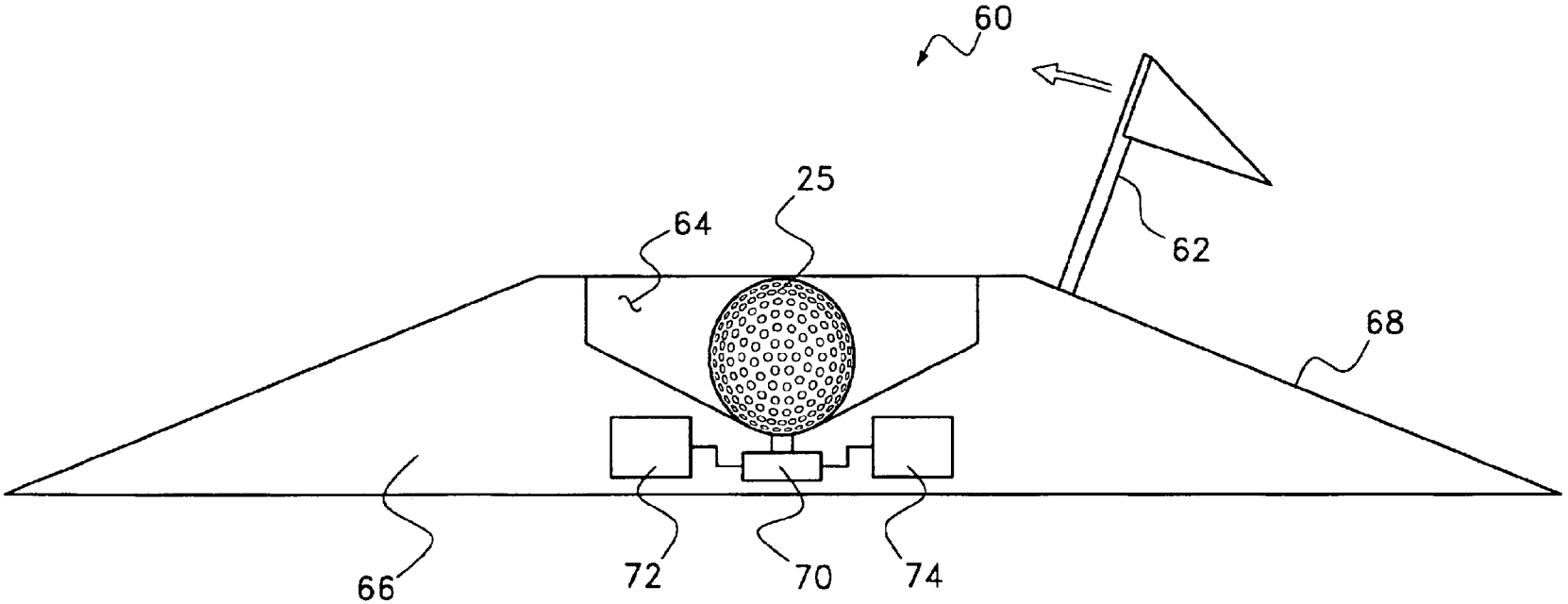
FIG. 4 shows a combined cross-sectional view and functional schematic of a third exemplary embodiment of the present invention ball target.

The present invention can be embodied without a mechanical activation system. Referring to FIG. 4, it can be seen that a ball target 60 can be manufactured that raises a flag indicator 62 with a secondary activation system. In FIG. 4, a cup 64 is formed in the base section 66 of a ball target 60. The cup 64 can be accessed by a rolling ball 25 using ramps 68. The ramps 68 can be positioned along any side or around all sides of the base section 66.

At the bottom of the cup 64 is a sensor 70. The sensor 70 can be a pressure switch, a light detector or any other sensor capable of detecting when a ball 25 has rolled into the cup 64. Within the ball target 60 are disposed batteries 72 and an electromechanical activation mechanism 74. The electromechanical activation mechanism 74 can be any device capable of rotating the flag indicator 62 from a down position to a raised position. In its simplest form, the flag indicator 62 can be spring biased into its raised position. The electromechanical activation mechanism 74 can be a simple solenoid activated release pin that holds the flag indicator 62 in its down position. When a ball 25 falls into the cup 64, the electro-mechanical activation mechanism 74 releases the flag indicator 62 and the flag indicator 62 moves into its raised position.

Using an electromechanical activation mechanism 74, the weight of the ball 25 is irrelevant to the functionality of the ball target 60. Consequently, the ball target 60 can be used by real golfers using regulation golf balls as well as children using plastic golf balls.

Regardless of which embodiment of the present invention ball target is used, the method of play remains the same. The ball target is placed on the floor or ground. A ball is then propelled toward the ball target so that the ball rolls toward the ball target. If the rolling ball rolls up a ramp of the ball target and falls into the cup, a flag indicator is automatically raised.

The present invention ball target can have a cup that is the size of a regulation golf hole. Consequently, the ball target can be used by seasoned golfers who want to practice putting as well as by children playing a simulated game of golf.

It will be understood that the embodiments of the present invention ball target that are specifically described and illustrated are merely exemplary and the shown embodiments can be modified in many ways. For example, the location of the ramps, size of the ramps, slope of the ramps, size of the cup, location of the flag indicator, and size of the flag indicator can all be changed to the whims of the product designer. Furthermore, there exist many different electromechanical assemblies that can be used to raise a flag indicator when activated. Any such prior art activators can be adapted for use with the present invention. All such alternate embodiments and variations are intended to be included within the scope of the claims as listed below.

What is claimed is:

1. A ball target assembly, comprising:

a base section having a top surface in which is disposed a cup;

at least one ramp extending from said base section, wherein said at least one ramp provides a surface up which a rolling ball approaching said base section can roll;

a flag indicator that includes an elongated rod and a flag connected to said elongated rod, said flag indicator being selectively positionable between a down position and a raised position, wherein said flag is held below said top surface of said base section when in said down position and wherein said flag is held above said top surface of said base section when in said raised position; and an activation mechanism for moving said flag indicator from said down position to said raised position when a ball is received in said cup.

2. The assembly according to claim 1, wherein said activation mechanism is a mechanical system that utilizes energy received by an incoming ball to move said flag indicator from said down position to said raised position.

3. The assembly according to claim 1, wherein said activation mechanism includes an axle rod that is connected to said flag indicator and at least one activator extending from said axle rod, said activator being positioned in a path of a ball rolling up said at least one ramp, wherein said activator rotates said axle rod and raises said flag indicator when contacted by a ball rolling along said path.

4. The assembly according to claim 1, wherein said activation mechanism includes an axle rod that is connected to said flag indicator and at least one activator extending from said axle rod, said activator being positioned in said cup, wherein said activator rotates said axle rod and raises said flag indicator when contacted by a ball rolling into said cup.

5. The assembly according to claim 1, further including a sensor disposed in said cup for sensing when a ball is received by said cup, wherein said activation mechanism is activated when said sensor detects a ball in said cup.

6. The assembly according to claim 1, wherein said cup has the diameter of a regulation golf hole.

7. A method for indicating when a ball has been received by a ball target, comprising the steps of:

providing a structure that defines a simulated golf hole;

providing a flag indicator; and providing an activation device for automatically raising said flag indicator when a ball rolls along a path to said simulated golf hole, said flag indicator including an axle rod and at least one activator that extends from said axle rod, wherein said activator is positioned in said path to said simulated golf hole and rotates said axle rod to raise said flag indicator when contacted by the ball.

8. The method according to claim 7, wherein said step of proving a structure includes proving a structure containing a base section and at least one ramp that extends from said base section, wherein said simulated golf hole is disposed in said base section.

9. A ball target assembly, comprising:

a base section having a top surface in which is disposed a cup; at least one ramp extending from said base section, wherein said at least one ramp provides a surface up which a rolling ball approaching said base section can roll;

a flag indicator that is selectively positionable between a down position and a raised position;

an activation mechanism for moving said flag indicator from said down position to said raised position when a ball is received in said cup, said activation mechanism including an axle rod that is connected to said flag indicator and at least one activator extending from said axle rod, said activator being positioned in a path of a ball rolling up said at least one ramp, wherein said activator rotates said axle rod and raises said flag indicator when contacted by a ball rolling along said path.

* * * * *